US008042205B2

(12) United States Patent
Schulz, Jr.

(10) Patent No.: US 8,042,205 B2
(45) Date of Patent: Oct. 25, 2011

(54) COMPACT FOUNDATION UNIT KIT AND METHOD OF MAKING SAME

(75) Inventor: Martin Schulz, Jr., Brenham, TX (US)

(73) Assignee: Rock Island Industries, Hempstead, TX (US)

( * ) Notice: Subject to any disclaimer, the term of this patent is extended or adjusted under 35 U.S.C. 154(b) by 224 days.

(21) Appl. No.: 12/350,303

(22) Filed: Jan. 8, 2009

(65) Prior Publication Data

US 2010/0170190 A1 Jul. 8, 2010

Related U.S. Application Data

(60) Provisional application No. 61/019,038, filed on Jan. 4, 2008.

(51) Int. Cl.
*A47C 19/00* (2006.01)

(52) U.S. Cl. ..... 5/200.1; 5/201; 5/400

(58) Field of Classification Search ..... 5/200.1, 5/201, 400, 282.1, 285, 286
See application file for complete search history.

(56) References Cited

U.S. PATENT DOCUMENTS

| | | | | |
|---|---|---|---|---|
| 3,605,141 | A * | 9/1971 | Silverman | 5/200.1 |
| 5,099,529 | A * | 3/1992 | Anderson | 5/400 |
| 5,701,653 | A * | 12/1997 | Rupe | 29/432 |
| 5,983,423 | A * | 11/1999 | Rupe | 5/236.1 |
| 6,286,161 | B1 * | 9/2001 | McCall | 5/400 |
| 6,865,758 | B2 * | 3/2005 | Harrow | 5/288 |
| 6,925,666 | B2 * | 8/2005 | Harrow | 5/201 |
| 7,155,762 | B2 * | 1/2007 | Harrow | 5/288 |
| 7,784,122 | B2 * | 8/2010 | Oh | 5/201 |
| 7,937,788 | B2 * | 5/2011 | Felix | 5/201 |
| 2003/0084509 | A1 * | 5/2003 | Harrow | 5/201 |
| 2004/0199997 | A1 * | 10/2004 | Harrow | 5/201 |
| 2005/0138729 | A1 * | 6/2005 | Harrow | 5/200.1 |
| 2006/0112485 | A1 * | 6/2006 | Harrow | 5/201 |
| 2006/0174407 | A1 * | 8/2006 | Harrow | 5/201 |
| 2007/0151026 | A1 * | 7/2007 | Felix | 5/201 |
| 2008/0208709 | A1 | 8/2008 | Craver | |
| 2009/0025143 | A1 * | 1/2009 | Oh | 5/201 |
| 2009/0271925 | A1 * | 11/2009 | Felix | 5/201 |
| 2009/0307842 | A1 * | 12/2009 | Harrow | 5/201 |
| 2010/0031440 | A1 * | 2/2010 | Harrow | 5/201 |
| 2010/0115696 | A1 * | 5/2010 | Felix et al. | 5/201 |
| 2010/0154118 | A1 * | 6/2010 | Pearce | 5/201 |
| 2010/0175186 | A1 * | 7/2010 | Harrow | 5/400 |
| 2010/0275372 | A1 * | 11/2010 | Oh | 5/201 |

* cited by examiner

*Primary Examiner* — Robert G Santos
(74) *Attorney, Agent, or Firm* — Barnes & Thornburg LLP

(57) ABSTRACT

A compact foundation unit kit and a method of making a foundation unit from the kit. The kit comprises at least three elongated, generally flat truss rails, four generally flat end caps and a plurality of generally flat cross slats, with the truss rails, end caps and cross slats oriented together with their longitudinal dimensions aligned in a generally parallel orientation and with their flat sides in contact. A binding maintains the truss rails, end caps and cross slats in that orientation. The method includes providing the kit, opening the kit and orienting the truss rails in a parallel, spaced position, then affixing one of the end caps to each end of the truss rails, inverting the partially formed foundation, and affixing the last two end caps to opposite ends of the truss rails, then finally affixing the cross slats to the truss rails in a spaced, parallel orientation. The foundation can then be finished in a conventional fashion.

6 Claims, 6 Drawing Sheets

COMPACT FOUNDATION UNIT KIT AND METHOD OF MAKING SAME

RELATED APPLICATION

This application is the non-provisional filing of provisional U.S. Application No. 61/019,038 filed Jan. 4, 2008.

BACKGROUND OF THE INVENTION

This invention relates to foundation units, and in particular to a compact foundation unit kit and a method of erecting a foundation unit from the compact foundation unit kit.

Foundation units have been used for years, and are composed of various materials such as steel, wood, combinations of steel and wood, and other materials, which are then provided with an appropriate covering. Examples of foundation units are found in U.S. Pat. Nos. 4,377,279; 5,346,188 and 5,622,357.

The problem with existing foundation units is shipment. Foundation units typically occupy considerable space, and are not easily shipped in a disassembled form with ready assembly after shipping. Therefore, shipping costs can be quite considerable, limiting the distance which assembled foundation units can be shipped in a cost effective manner.

SUMMARY OF THE INVENTION

The invention is directed to a foundation unit which is particularly suitable for shipping in a partially disassembled fashion and ready assembly after it has been shipped. The foundation unit is provided in a compact foundation unit kit, which comprises at least three elongated, generally flat truss rails, each having a longitudinal dimension and flat sides. Four generally flat end caps are provided, each having a longitudinal dimension and flat sides. A plurality of generally flat cross slats is provided, each having a longitudinal dimension and flat sides. The truss rails, end caps and cross slats are oriented together with their longitudinal dimensions aligned in a generally parallel orientation and with at least some of their flat sides in contact with one another. A binding maintains the truss rails, end caps and cross slats in that orientation.

In accordance with the preferred form of the invention, included also are two generally flat side filler strips which complete the upper surface of the foundation unit. Alternatively, the side filler strips can be omitted, with the cross slats being appropriately dimensioned to extend the entire width of the foundation unit.

In the preferred form of the invention, the binding comprises at least one enveloping strap. The strap is of a material that can be easily severed to allow the assembly of the foundation unit.

In one form of the invention, each truss rail includes a plurality of triangular reinforcements. The reinforcements comprise wires affixed proximate the top and bottom of each truss rail in an alternating fashion.

In one form of the method according to the invention, the method includes providing the truss rails, end caps and plurality of cross slats, and then forming the truss rails, end caps and cross slats into the kit. Subsequently, the kit is opened and the side rails are oriented in a parallel, spaced position. One of the end caps is affixed to the truss rails at one end thereof, and a second of the end caps is affixed to the truss rails at an opposite end to form a partial foundation. Then, the partial foundation is inverted, and a third of the end caps is affixed to the truss rails at one end thereof and a fourth of the end caps is applied to the truss rails at the opposite end. The cross slats are then affixed to the truss rails in a spaced, parallel orientation between the third and fourth end caps to form an upper support.

After assembly of the foundation unit, it can be completed by a final step of applying a finish surface to the upper support. The finish surface can be a conventional structure, such as a wire grid, cardboard or composite mat, or the like. An appropriate covering can then be applied.

In accordance with the preferred form of the method, two of the side filler strips are also provided in the kit, and, after the cross slats are affixed, the method includes the further step of affixing one filler strip to one side of the upper support and a second side filler strip to the opposite side of the upper support.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
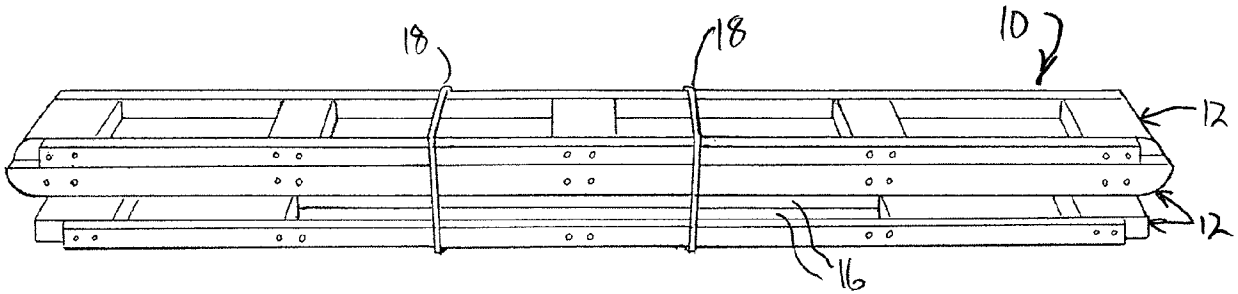
FIG. 1 is a perspective view of a foundation unit kit, showing its component parts when bound together.
Figure 8:
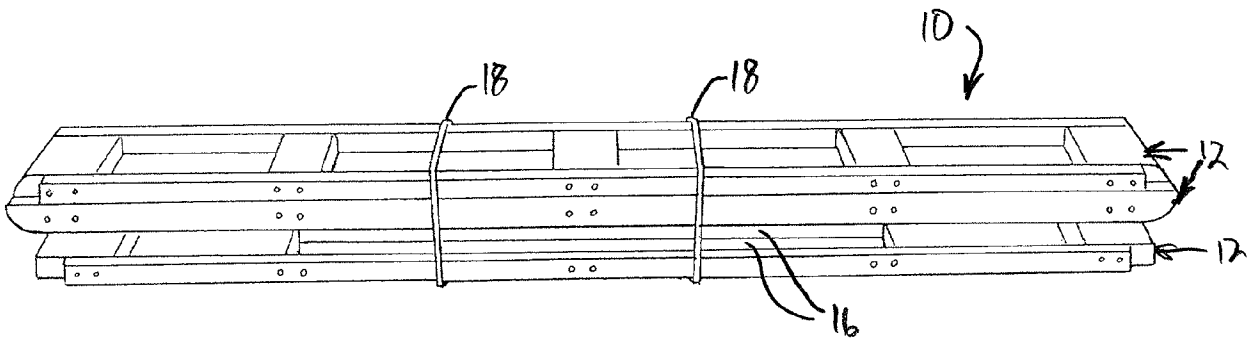
FIG. 8 is a view similar to FIG. 1, for a second embodiment of the invention.
Figure 9:
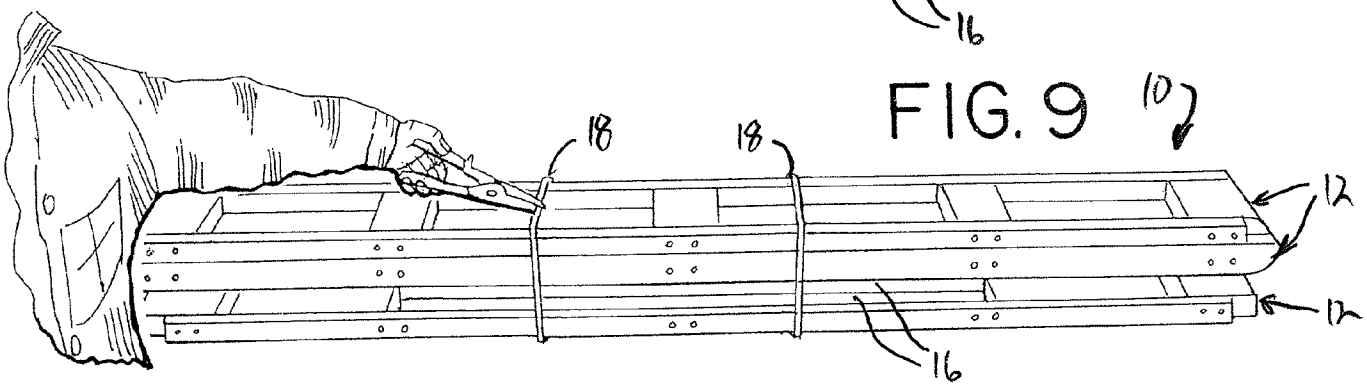
FIG. 9 is a view similar to FIG. 2, for the second embodiment of the invention.
Figure 10:
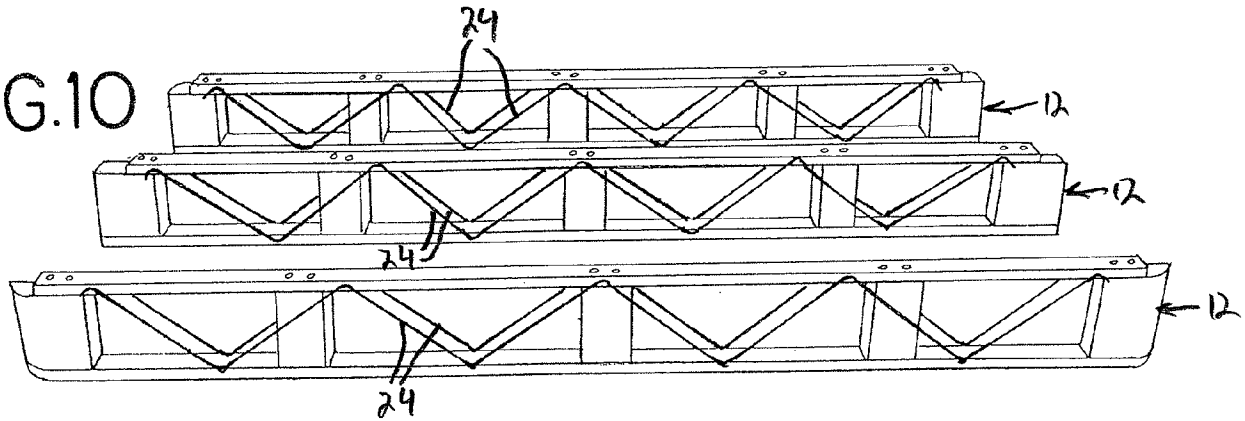
FIG. 10 is a view similar to FIG. 3 for the second embodiment of the invention, and showing details of reinforcement of the truss rails.
Figure 11:
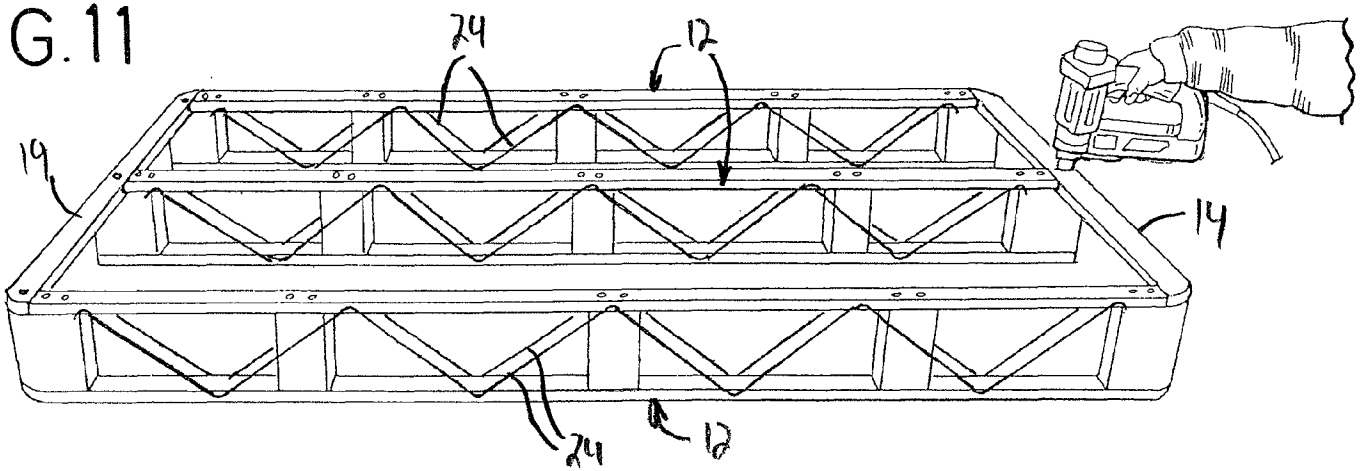
FIG. 11 is a view similar to FIG. 4 showing attachment of the end caps.
Figure 12:
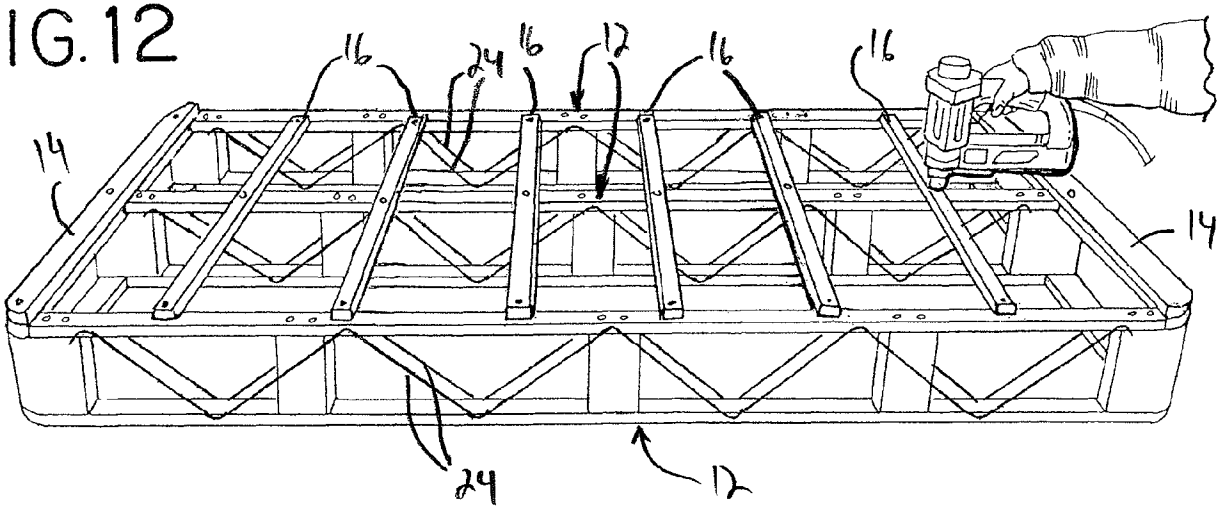
FIG. 12 is a view similar to FIG. 5, showing attachment of end caps and slats to the top deck, after the unit has been inverted.
Figure 13:
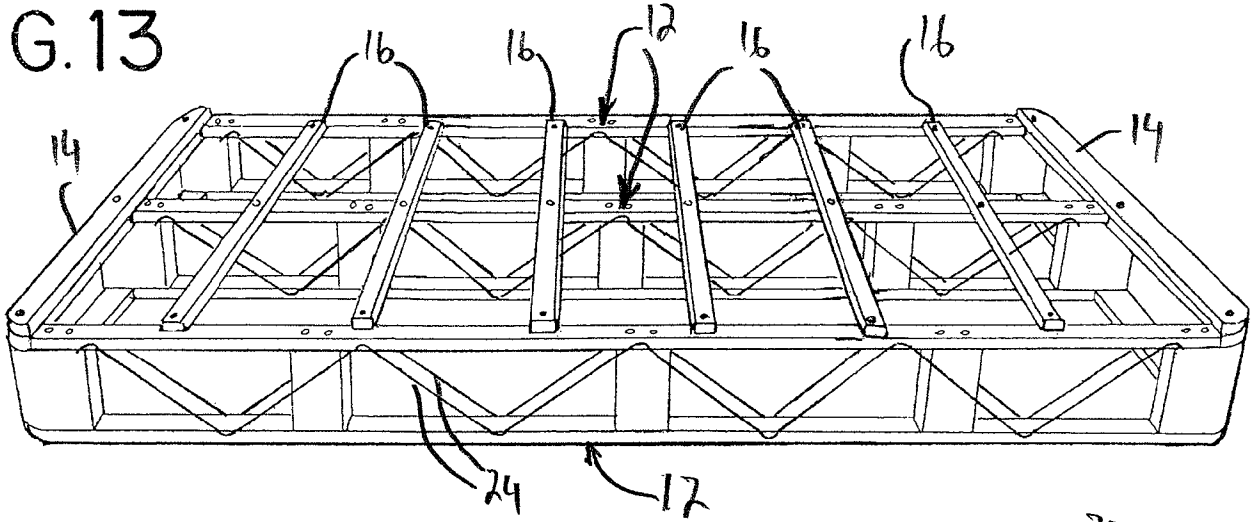
FIG. 13 is a view similar to FIG. 6, showing the completed structure of the foundation unit without the longitudinal side filler strips.
Figure 14:
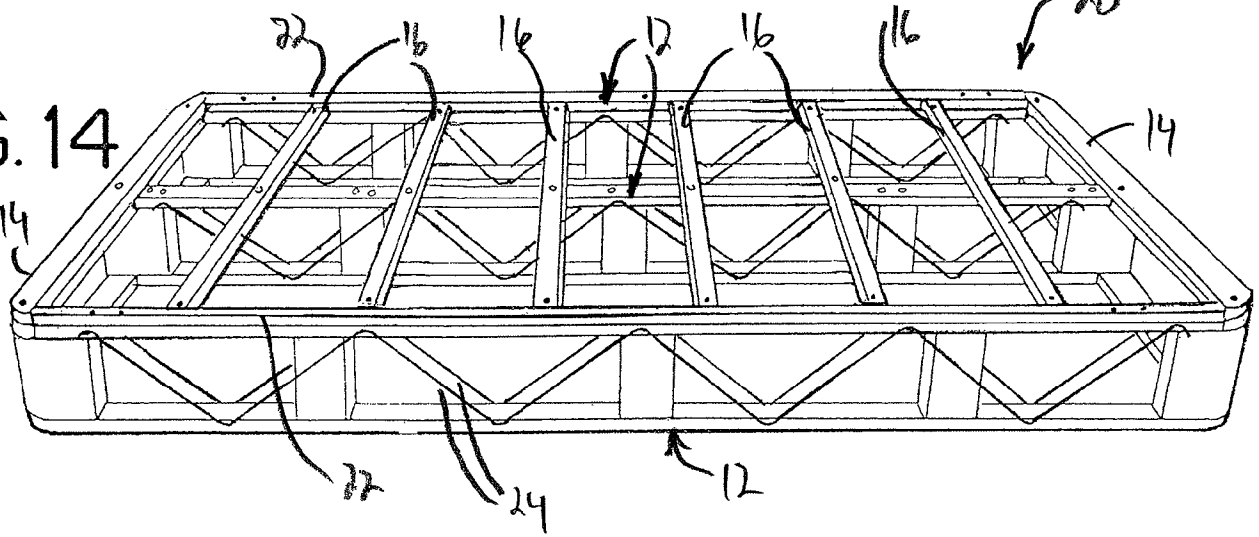
FIG. 14 is a view similar to FIG. 7 with the longitudinal side filler strips in place.

A compact foundation unit kit, as assembled, is shown in FIGS. 1 and 2 and again in FIGS. 8 and 9 in relation to the second embodiment, with the components of the foundation unit kit being shown in the remaining drawing figures. The compact foundation unit kit of the first embodiment of the invention is generally designated at 10 in the drawing figures, and includes at least three elongated, generally flat truss rails 12, four generally flat end caps 14, and a series of generally flat cross slats 16.

The truss rails 12, end caps 14 and cross slats 16 have generally flat sides, and a longitudinal dimension. In the kit 10, the truss rails 12, end caps 14 and cross slats 16 are oriented together with their longitudinal dimensions aligned in a generally parallel fashion with their flat sides in contact with another, forming a compact kit. A binding 18 is used to maintain the kit 10 in the orientation illustrated in the drawing figures, and preferably the binding 18 comprises one or more suitable straps which, as illustrated in the drawing figures, can be cut or otherwise removed so that the components of the kit can be assembled into the foundation unit as described below.

As shown in the drawing figures, the truss rails 12 are preferably formed of a series of elements that is assembled in the manner illustrated, and can be made of word, as are the end caps 14 and cross slats 16, so that there is ease of assembly by nailing, gluing or otherwise affixing elements to one another. As shown in the drawing figures, the components of the ultimately-assembled foundation unit result in about a seventy percent pre-assembled foundation unit which is completed as described below. Also, while the truss rails are shown as being formed of multiple elements that have been nailed or otherwise affixed, a truss rails 12 can be formed of other materials and in other shapes, such as elongated I-beams, so long as the truss rails 12 are, as illustrated, formed longitudinally and generally flat.

Figure 2:
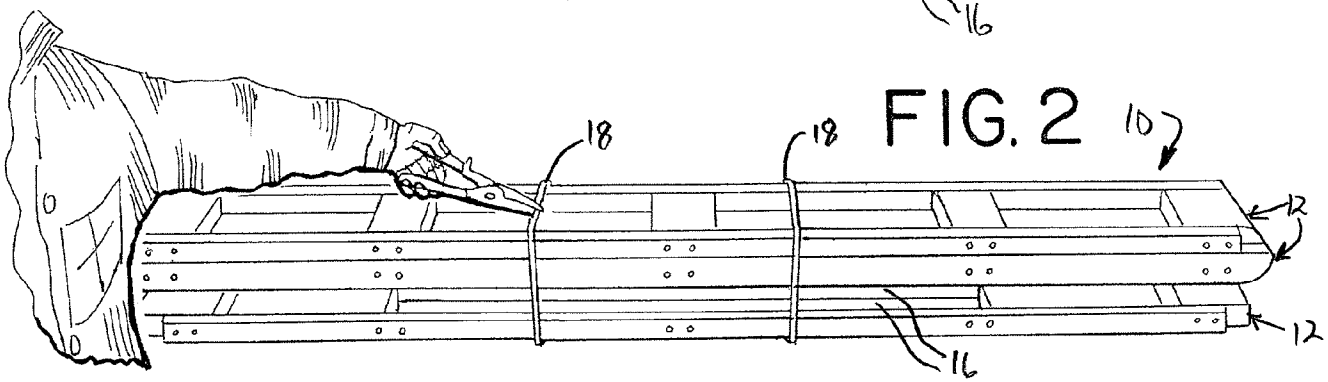
FIG. 2 is an illustration similar to FIG. 1, and illustrating preparation for assembly.
Figure 3:
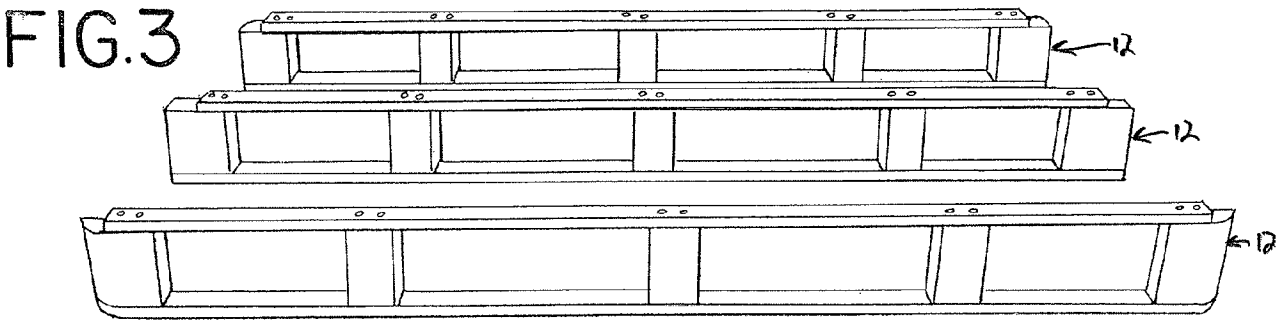
FIG. 3 shows the truss rails in place and ready for commencement of the assembly of the foundation unit.
Figure 4:
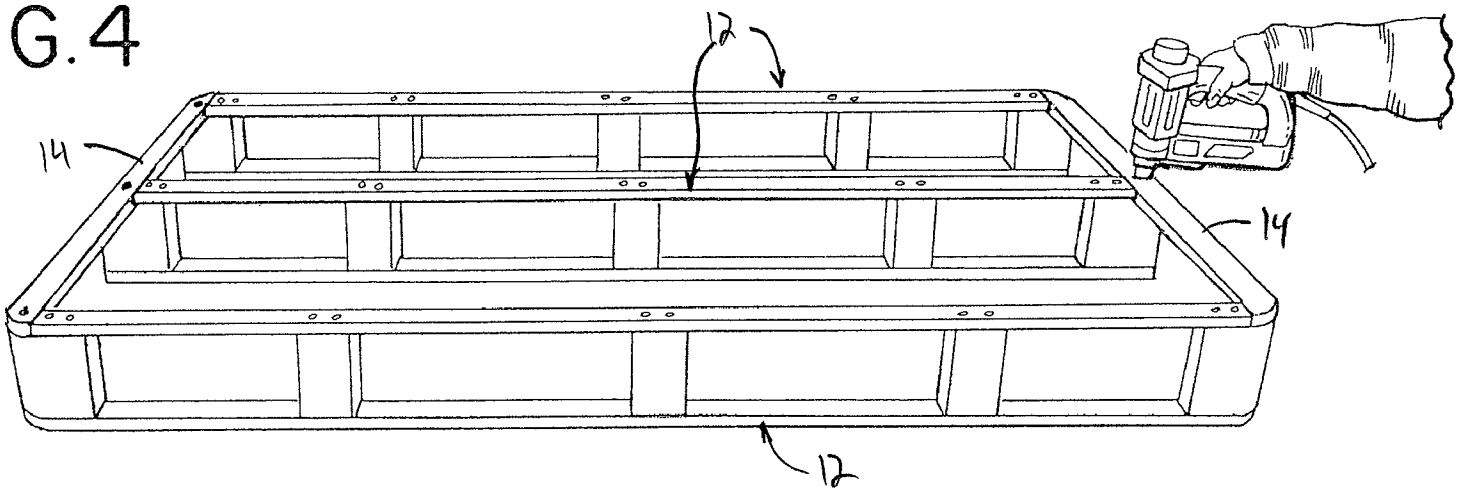
FIG. 4 illustrates that first step in the assembly by attachment of end caps to what ultimately is the bottom of the foundation unit.
Figure 7:
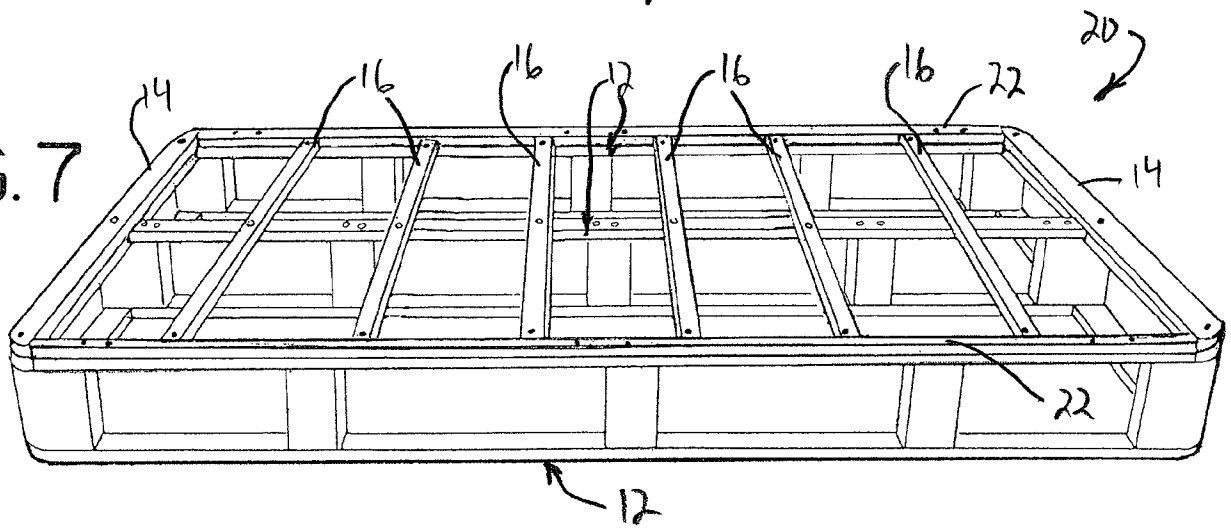
FIG. 7 is an illustration similar to FIG. 6, but showing filler strips which smooth the longitudinal side edges.

Assembly of a foundation unit 20, as ultimately formed and illustrated in FIG. 7, is shown in FIGS. 3 through 7. First, after the binding 18 has been severed, as shown in FIG. 2, the truss rails 12 are spaced apart in a parallel fashion as shown in FIG. 3. Then, in a first step of assembly, first and second end caps 14 are affixed in place as shown in FIG. 4 in end notches in the cross slats 16 to form what is ultimately the bottom of the foundation unit 20.

Figure 5:
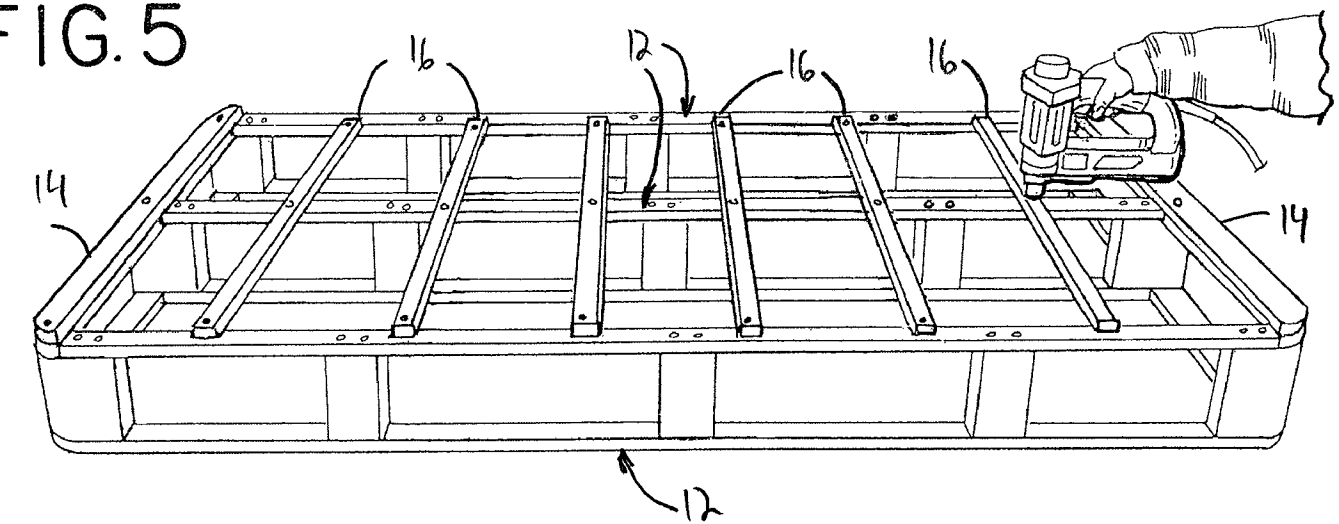
FIG. 5 shows continuation of assembly of the foundation unit, after inversion, by attaching end caps and slats to the top deck.
Figure 6:
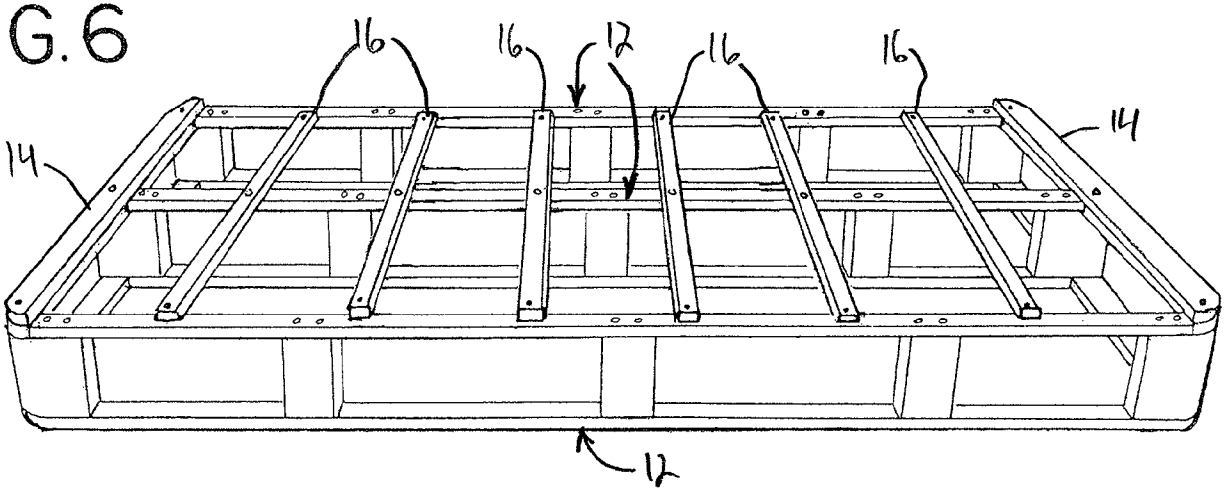
FIG. 6 shows a complete foundation, but without side filler strips to smooth the longitudinal side edges.

Once the first two end caps 14 are in place as shown in FIG. 4, the assembly is inverted to the orientation shown in FIG. 5, and the third and fourth end caps 14 are affixed in place. Then, the cross slats 16 are applied in a spaced fashion as shown in FIG. 5, resulting in the structure shown in FIG. 6.

Finally, in order to complete the foundation unit 20, a pair of side filler strips 22 is provided and fixed in place, resulting in the foundation unit 20 shown in FIG. 7. While it is preferred that the elements 12, 14, 16 and 22 are nailed together in all aspects for ease of assembly, other means of affixing them, such as adhesives, can be used, as well.

While it is not mandatory, it is preferred that the side filler strips 22 be used to complete the foundation unit 20. These side filler strips 22 are normally included as part of the compact foundation unit kit 10, and are the last elements placed to complete the foundation unit 20.

The embodiment of the invention shown in FIGS. 8 through 14 is identical to that of FIGS. 1 through 7, except that the truss rails 10 are reinforced by a plurality of triangular reinforcements. As illustrated, the triangular reinforcements comprise a series of wires 24 fixed proximate the top and bottom of each of the truss rails in an alternating fashion. As illustrated, the wires 24 can be installed on both sides of each of the truss rails 12, or one side, as needed, and can be affixed in place by nails, staples or any other means of affixing the wires 24 in place on the truss rails 12 as shown in FIGS. 10 through 14.

Once the foundation unit 20 is fabricated, it can be completed in a conventional fashion by adding a steel grid or cardboard deck to its top deck (on top of the end caps 14, cross slats 16 and side filler strips 22). As it is conventional, appropriate fabric covering and padding, if needed, can be applied to produce a finished foundation.

Various changes can be made to the invention without departing from the spirit thereof or scope of the following claims.

What is claimed is:

1. A method of making a foundation unit, comprising the steps of a. providing at least three elongated, preassembled truss rails, four end caps and a plurality of cross slats, b. assembling said truss rails, end caps and cross slats together and substantially abutting one another into a kit, c. subsequently opening the kit and orienting said truss rails in a parallel, spaced position, wherein all of the truss rails are substantially identical, d. affixing one of said end caps to said truss rails at one end thereof and affixing a second of said end caps to said truss rails at an opposite end to form a partial foundation, e. inverting said partial foundation, f. affixing a third of said end caps to said truss rails at one end thereof and affixing a fourth of said end caps to said truss rails at an opposite end, and g. affixing said cross slats to said truss rails in a spaced, parallel orientation between said third and fourth end caps to form an upper support, such that the respective top surfaces of each of said end caps and said cross slats are substantially coplanar and vertically disposed above the respective top surfaces of said truss rails.

2. The method according to claim 1, including the final step of applying a finish surface to said upper support.

3. The method according to claim 1, including, in step a, providing two side filler strips and, after step g, including the further step of affixing one side filler strip to one side of said upper support and a second side filler strip to an opposite side of said upper support.

4. A method of making a foundation unit, comprising the steps of a. providing a kit comprising a plurality of elongated, preassembled truss rails, four end caps and a plurality of cross slats, said truss rails, end caps and cross slats being together and substantially abutting one another, b. subsequently opening the kit and orienting said truss rails in a parallel, spaced position, wherein all of the truss rails are substantially identical, c. affixing one of said end caps to said truss rails at one end thereof and affixing a second of said end caps to said truss rails at an opposite end to form a partial foundation, d. inverting said partial foundation, e. affixing a third of said end caps to said truss rails at one end thereof and affixing a fourth of said end caps to said truss rails at an opposite end, and f. affixing said cross slats to said truss rails in a spaced, parallel orientation between said third and fourth end caps to form an upper support, such that the respective top surfaces of each of said end caps and said cross slats are substantially coplanar and vertically disposed above the respective top surfaces of said truss rails.

5. The method according to claim 4, including the final step of applying a finish surface to said upper support.

6. The method according to claim 4, including, in step a, providing two side filler strips and, after step f, including the further step of affixing one side filler strip to one side of said upper support and a second side filler strip to an opposite side of said upper support.

* * * * *